United States Patent [19]

Bingold et al.

[11] Patent Number: 4,647,897

[45] Date of Patent: Mar. 3, 1987

[54] POTENTIOMETER HAVING SWITCHING FUNCTION

[75] Inventors: Steven R. Bingold, Portland, Oreg.; Jeffrey A. Kleck, Vancouver, Wash.; Kenneth P. Dobyns, Beaverton, Oreg.

[73] Assignee: Tektronix, Inc., Beaverton, Oreg.

[21] Appl. No.: 855,528

[22] Filed: Apr. 23, 1986

[51] Int. Cl.[4] ..... H01C 10/36

[52] U.S. Cl. ..... 338/172; 338/174; 338/324; 338/325; 338/198

[58] Field of Search ..... 338/172, 174, 175, 180, 338/188, 191, 190, 324, 325, 328, 198, 200

[56] References Cited

U.S. PATENT DOCUMENTS 2,873,336 2/1959 Tassara ..... 338/174 X 3,990,033 11/1976 Wall ..... 338/174 X 4,041,439 8/1977 Steddom et al. ..... 338/324 X

*Primary Examiner*—C. L. Albritton

*Attorney, Agent, or Firm*—William O. Geny

[57] ABSTRACT

A potentiometer which provides the function of an on/off switch includes a center conductor connected to a conductive ring and a resistive element concentrically disposed about the conductive ring. The resistive element includes a pair of termination pads and one of the pads includes a branch which is situated outside the outer periphery of the resistive element. As a wiper arm traverses the resistive element it remains in contact with the branch for a brief distance and then loses contact with it. This causes the value of the resistance in the potentiometer to make an abrupt shift in magnitude which can be used to initiate various switching functions.

3 Claims, 3 Drawing Figures

POTENTIOMETER HAVING SWITCHING FUNCTION

BACKGROUND OF THE INVENTION

The following invention relates to a potentiometer and more particularly to a potentiometer which includes a switching function.

Potentiometers typically provide a variable resistance to the flow of electrical current in a circuit. The resistance provided by a potentiometer ranges from a very small resistance to a maximum resistance which is arbitrarily chosen by the user for the particular application involved. A problem with potentiometers is that a wiper arm which traverses a resistive element must always rest on a portion of the resistive element, even near its termination point, such that there are no abrupt transitions in voltage from one portion of the resistive element to another. Moreover, most potentiometers are designed to be linear with movement of the wiper arm.

In those circuits in which switches are used in conjunction with potentiometers, it is necessary to use separate contact elements to perform the switching function and the potentiometer function, respectively. Having two such components takes up space which is often at a premium in electrical subassemblies.

SUMMARY OF THE INVENTION

The present invention provides an apparatus for combining the potentiometer and switching functions in a single component having common electrical elements. The potentiometer comprises a center conductor which includes a conductive ring and a resistive element concentrically disposed around the conductive ring. The resistive element terminates in first and second termination pads, and one of the termination pads includes a conductive branch situated outside of the outer periphery of the resistive element. A wiper arm connected to the conductive ring, which traverses the periphery of the resistive element, extends past the periphery of the resistive element a distance sufficient to make electrical contact with the conductive branch. The conductive branch is formed in substantially the shape of an arc which is concentric with or has the same radius of curvature as the resistive element. When the wiper arm leaves the branch, there is an abrupt transition in voltage across the potentiometer which can be used for switching purposes.

It is a principal object of this invention to provide a potentiometer and a switch having common elements and functions so as to save space in an assembly containing an electrical circuit.

A further object of this invention is to provide a potentiometer which is also capable of functioning as an on/off switch.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
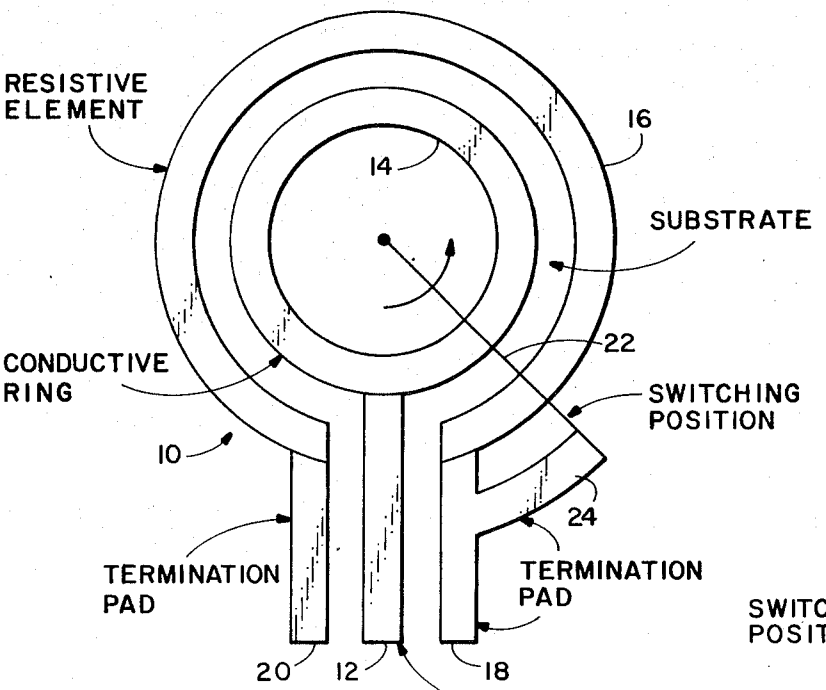
FIG. 1 is a schematic drawing of the physical layout of a potentiometer having a switching function constructed according to the present invention.

Referring to FIG. 1, a switching potentiometer 10 includes a center conductor 12 which is connected to an inner conductive ring 14. Concentrically disposed with respect to the conductive ring 14 is a resistive element 16 which includes a pair of termination pads 18 and 20. A wiper arm 22 makes continuous contact with both the conductive ring 14 and the resistive element 16 as it traverses the resistive element 16 in a counterclockwise direction as indicated by the arrow in FIG. 1.

Termination pad 18 includes a branch 24 which parallels the termination pad 18 and is situated outside the periphery of the resistive element 16. The wiper arm 22 extends past the outer periphery of the resistive element 16 to make contact with the branch 24 of the termination pad 18.

Figure 2:
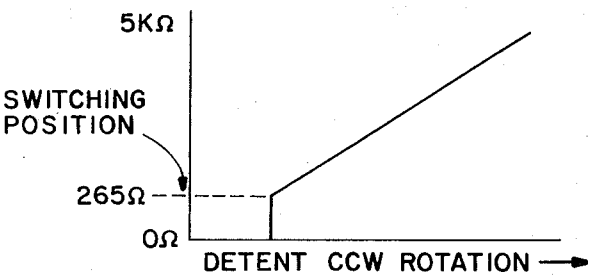
FIG. 2 is a graph showing resistance levels of the potentiometer in FIG. 1, as a function of the rotation of its wiper arm.

The effect of the construction schematically illustrated in FIG. 1 is shown in the graph in FIG. 2. As the wiper arm 22 is moved in a counterclockwise direction, the resistance between the center conductor 12 and the termination pad 18 will be zero because the wiper arm will make electrical contact with the branch 24 of the termination pad 18. However, the branch 24 terminates after approximately 10° of counterclockwise rotation by the wiper arm 22. At this point, the only conductive path is provided through the resistive element 16, and the resistance of the potentiometer abruptly jumps to a value determined by the amount of resistive material in the arc traversed by the wiper arm 22. In the example in FIG. 2, the arbitrarily chosen value of 265 ohms is indicated by the dashed line. In this embodiment the maximum resistance provided by the potentiometer 10 is 5,000 ohms.

Figure 3:
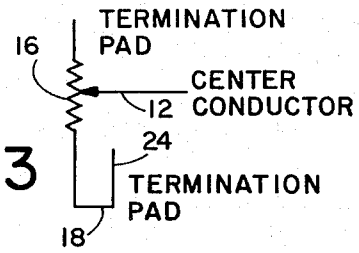
FIG. 3 is a simplified schematic diagram of the potentiometer shown in FIG. 1.

FIG. 3 shows a simplified schematic of the switching potentiometer of FIG. 1. The center conductor 12 makes electrical contact with the resistive element 16 until the conductor reaches the branch 24 of the termination pad 18, at which point the center conductor is effectively short circuited to the termination pad 18 and the resistance drops to zero. This abrupt transition in resistance allows the potentiometer to function as a switch. Moreover, the invention is not limited to instances in which the branch 24 is a non-resistive continuation of termination pad 18. As an alternative, the branch 24 could include resistive material, in which case there would be some finite resistance as the wiper arm traversed both the branch 24 and the resistive element 16. However, as soon as the wiper arm loses contact with the branch 24, there will be an abrupt change in resistance. It is the abrupt change in resistance which may be used in an electrical circuit to provide a switching function since certain circuit elements may be responsive to abrupt changes in voltage levels to turn on or turn off. This technique may be particularly applicable to digital logic elements which may be responsive to arbitrarily set "high" and "low" voltage levels.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A potentiometer comprising:

(a) a center conductor including a conductive ring;

(b) a resistive element concentrically disposed about said conductive ring and separated therefrom, said resistive element terminating in first and second termination pads wherein one of said termination pads includes a conductive branch situated outside the outer periphery of said resistive element; and (c) a wiper arm connected to said conductive ring for traversing the periphery of said resistive element, wherein said wiper arm extends past the periphery of said resistive element a distance sufficient to make electrical contact with said conductive branch.

2. The potentiometer of claim 1 wherein said conductive branch is formed in the shape of an arc having substantially the same radius of curvature as said resistive element.

3. The potentiometer of claim 1 wherein said conductive branch includes a resistive component to provide electrical resistance to electrical current flowing through said branch.

* * * * *